US005588590A

United States Patent [19]

Sakakibara et al.

[11] Patent Number: 5,588,590

[45] Date of Patent: Dec. 31, 1996

[54] EXPANSION VALVE COMBINED WITH A SOLENOID VALVE

[75] Inventors: Hisayoshi Sakakibara, Nishio; Tomoo Okada; Tadaaki Ikeda, both of Sayama, all of Japan

[73] Assignees: Kabushiki Kaisha Saginomiya Seisakusho, Tokyo; Nippondenso Co., Ltd., Aichi, both of Japan

[21] Appl. No.: 350,061

[22] Filed: Nov. 29, 1994

[30] Foreign Application Priority Data

Nov. 30, 1993 [JP] Japan ..... 5-299887

[51] Int. Cl.[6] ..... F25B 41/04

[52] U.S. Cl. ..... 236/92 B; 62/225; 137/614

[58] Field of Search ..... 62/225; 236/92 B; 137/614

[56] References Cited

U.S. PATENT DOCUMENTS

| | | | |
|---|---|---|---|
| 2,841,174 | 7/1958 | Frye | 137/539 X |
| 3,699,778 | 10/1972 | Orth | 62/225 |
| 4,065,939 | 1/1978 | Thornbery et al. | 62/217 |
| 4,112,704 | 9/1978 | Kaneko | 62/217 |
| 4,925,196 | 5/1990 | Green et al. | 137/613 X |
| 4,926,652 | 5/1990 | Kitamoto | 62/225 X |
| 5,251,459 | 10/1993 | Grass et al. | 236/92 B X |

FOREIGN PATENT DOCUMENTS

| | | |
|---|---|---|
| 0560635A1 | 3/1993 | European Pat. Off. . |
| 62-041481 | 2/1987 | Japan . |

*Primary Examiner*—William E. Tapolcai
*Attorney, Agent, or Firm*—Lowe, Price, LeBlanc & Becker

[57] ABSTRACT

This invention provides an expansion valve combined with a solenoid valve which prevents a water hammer phenomenon from occurring when a refrigerant passage is opened and closed by the solenoid valve. Refrigerant passages (P1, P2) are formed in a valve body (1) between a primary port (1*a*) and a secondary port (1*b*). The solenoid valve (V) attached to the valve body (1) opens and closes the refrigerant passages (P1, P2) in their intermediate portion. An expansion valve disk (6)—which is moved by the action of a diaphragm (8) that defines an outer pressure chamber (R2) communicating to a temperature sensing cylinder (E) and an inner pressure chamber (R1)—is brought into and out of engagement with a valve seat (S1) formed on the primary port (1*a*) side of the refrigerant passage (P1). The secondary port (1*b*) side and the inner pressure chamber (R1) are communicated via an inner pressure equalizing hole (15) formed in the valve body (1).

11 Claims, 5 Drawing Sheets

EXPANSION VALVE COMBINED WITH A SOLENOID VALVE

BACKGROUND OF THE INVENTION

1. Field of the Invention

The present invention relates to an expansion valve combined with a solenoid valve which is installed in a piping in a refrigeration cycle.

2. Description of the Prior Art

In the conventional refrigeration cycle, an expansion valve is paired with an evaporator and the flow of refrigerant is automatically controlled according to the refrigerating load of the evaporator.

The refrigeration cycle often employs a plurality of evaporators, as in multiple air conditioners and a multistage showcase of a freezer. In this case, because supplying a refrigerant to an evaporator not used is a waste of energy, the flow of refrigerant of liquid phase is stopped by a solenoid valve provided to the evaporator (Japanese Patent Preliminary Publication No. Showa 62-41481).

In a construction where a solenoid valve and an expansion valve are connected together, when the solenoid valve is opened to start the evaporator that was stopped, the refrigerant strikes violently against the inlet of the expansion valve, generating noise and causing a hunting phenomenon in which the expansion valve opens and closes repetitively at short intervals. The impact wave caused by the refrigerant becomes more violent as the amount of refrigerant flowing in increases according to the diameter of the solenoid valve, and its magnitude becomes larger as the capacity of the passage in the solenoid valve and the expansion valve increases. Thus, there is a growing possibility of the expansion valve and the piping being damaged. When the solenoid valve is closed, the flow of the liquid refrigerant is stopped suddenly, causing impact noise by water hammer.

To deal with this problem, the solenoid valve is provided downstream of the expansion valve. This construction has been found to have the following advantages. When the solenoid valve is opened, because there is no throttled portion downstream of the solenoid valve, an impact noise is not produced. When the solenoid valve is closed, the impact noise that is produced at time of closure of the solenoid valve is substantially reduced as the refrigerant throttled by the expansion valve located upstream of the solenoid valve is gasified.

SUMMARY OF THE INVENTION

The present invention has been accomplished based on the above findings and is intended to simplify the construction of the refrigeration cycle by integrally combining a solenoid valve and an expansion valve.

To achieve the above objective, this invention offers the following construction. That is, an expansion valve combined with a solenoid valve of this invention comprises a valve body with a primary port and a secondary port formed therein; a refrigerant passage formed in the valve body between the primary port and the secondary port; a solenoid valve attached to the valve body to open and close the refrigerant passage at an intermediate portion thereof; a diaphragm defining an outer pressure chamber and an inner pressure chamber, said outer pressure chamber being communicated to a temperature sensing means; an expansion valve member moved by action of the diaphragm to come into or out of contact with a valve seat formed at the primary port side of the refrigerant passage; and an inner pressure equalizing hole formed in the valve body to communicate the secondary port side with the inner pressure chamber.

When the solenoid valve is closed, the downstream side of the refrigerant passage in the valve body is depressurized, so that the low-pressure refrigerant is supplied through the inner pressure equalizing hole to the inner pressure chamber defined by the diaphragm.

The above and other objects, features and advantages of this invention will become apparent from the following description and the appended claims, taken in conjunction with the accompanying drawings.

DETAILED DESCRIPTION OF PREFERRED EMBODIMENT

Figure 1:
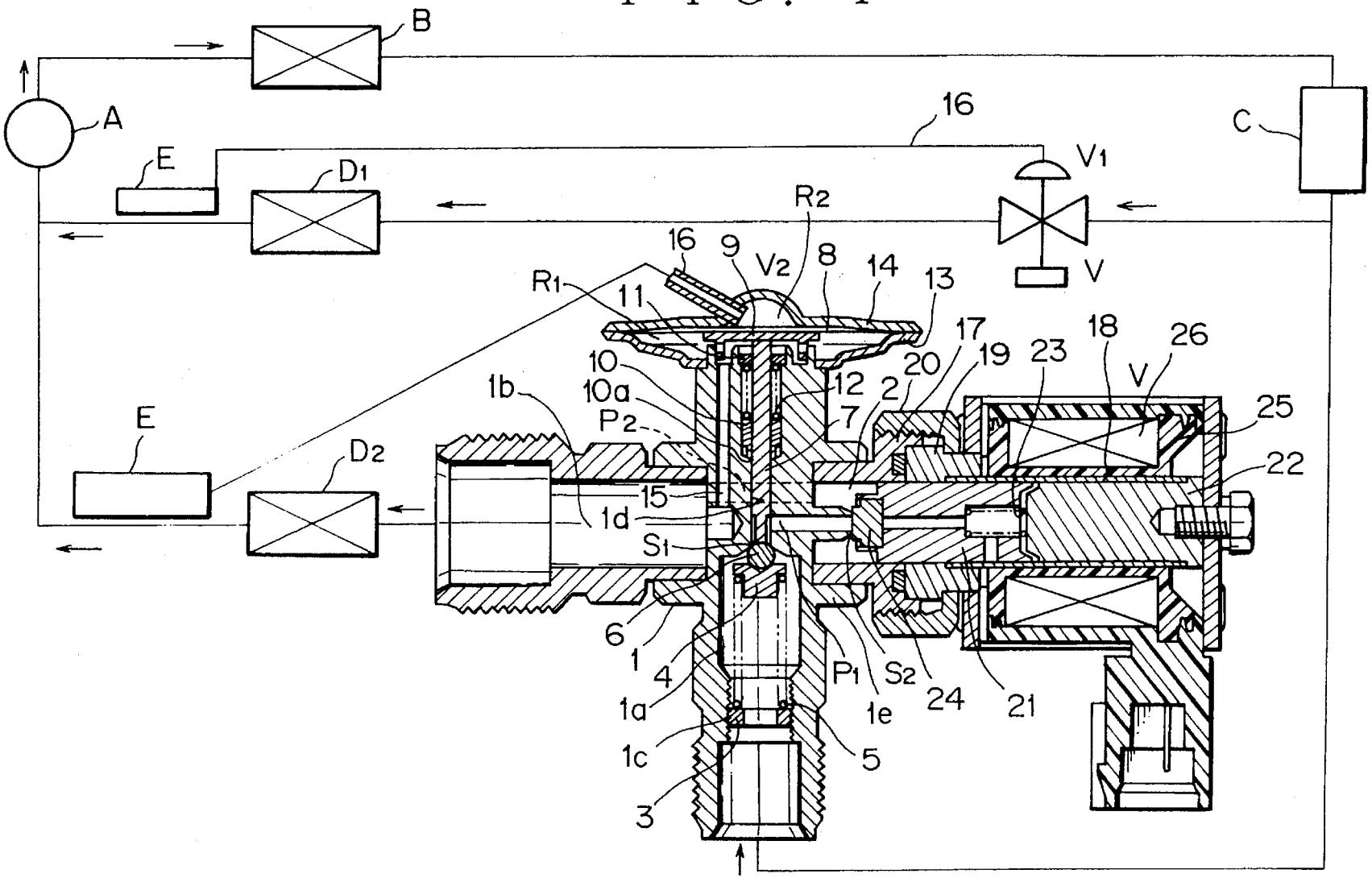
FIG. 1 is a schematic diagram of a refrigeration cycle of one embodiment of this invention, with an expansion valve incorporating a solenoid valve shown cut away.

FIG. 1 shows a refrigeration cycle of a multi-air conditioner. A high-pressure refrigerant delivered from a compressor A passes through an outdoor heat exchanger B and a receiver C, from which it further flows past a first expansion valve V1 and a second expansion valve V2 to reduce its pressure. The low-pressure refrigerant now flows through a first indoor heat exchanger D1 and a second indoor heat exchanger D2 and returns to the compressor A.

The first expansion valve V1 and the second expansion valve V2 are each provided with a solenoid valve V. The expansion valves V1, V2, as detailed in the expansion valve V2, each have between a primary port la and a secondary port 1*b* of the valve body 1 a first refrigerant passage P1 and a second refrigerant passage P2. The first refrigerant passage P1 extends from the primary port 1*a* and bends at almost right angles to reach a valve chamber 2 of the solenoid valve V. The second refrigerant passage P2 extends from the valve chamber 2 to the secondary port 1*b*. At both ends of the first refrigerant passage P1 there are formed valve seats S1, S2.

In the primary port 1*a*, a pressure setting coil spring 5 is provided between an adjust spring retainer 3 screwed into a female threaded portion 1*c* of the valve body 1 and a floating spring retainer 4. An expansion valve disk 6 supported by the floating spring retainer 4 is brought into and out of engagement with the valve seat S1. In the valve body 1 is formed a sliding hole 1*d* that is linearly continuous with the first refrigerant passage P1 on the primary port 1*a* side. A working rod 7 is slidably inserted so as to extend from the sliding hole 1*d* into the first refrigerant passage P1. The working rod 7 engages the expansion valve disk 6 at one end and, at the other end, a support fitting 9 attached to a diaphragm 8 that works as a pressure responding member. Around the working rod 7 is provided a seal ring 10 whose pointed end 10*a* is pressed against the end of the sliding hole 1*d* by a coil spring 12 installed between the seal ring 10 and a spring retainer 11.

The diaphragm 8 is hermetically clamped at its periphery by a lower cover 13 and an upper cover 14, the lower cover 13 being secured to the upper end of the valve body 1. The diaphragm 8 defines an inner pressure chamber R1 and an outer pressure chamber R2. The inner pressure chamber R1 communicates with an inner pressure equalizing hole 15 connected to the low-pressure side of the secondary port 1*b*. The outer pressure chamber R2 is connected with a capillary tube 16 that extends to a temperature sensing cylinder E for detecting an excessive heat at the outlet of the indoor heat exchanger D1, D2.

The solenoid valve V is connected to the expansion valve V2 by fusing a jointing cylinder 17 to a connecting cylinder portion 1*e* provided on the side opposite the secondary port 1*b*, and fixing a valve body cylinder 19 fitted with a plunger tube 18 to the jointing cylinder 17 by a nut 20. In the jointing cylinder 17, the valve body cylinder 19 and the plunger tube 18 is movably installed a plunger 21, which is normally urged by a coil spring 23 arranged between the plunger 21 and an attracting core 22 to press a valve disk 24 supported at the end of the plunger 21 against the valve seat S2. Denoted 25 is a coil bobbin and 26 a solenoid coil.

In the above configuration, during the operation of refrigeration cycle, the energized solenoid valve V attracts the plunger 21, causing the valve disk 24 to part from the valve seat S2, so that the high-pressure liquid refrigerant flowing into the primary port 1*a* is depressurized and transformed by the first refrigerant passage P1 into a low-pressure gas refrigerant, which then flows past the second refrigerant passage P2 into the indoor heat exchanger D1, D2.

In the case of FIG. 1, because the first refrigerant passage P1 in the expansion valve V2 is closed by the valve disk 24 of the solenoid valve V, the second indoor heat exchanger D2 is at rest and the valve disk 6 parts from the valve seat to provide a valve opening corresponding to the outlet temperature of the second indoor heat exchanger D2, with a result that the high-pressure liquid refrigerant stays within the first refrigerant passage P1.

To start the second indoor heat exchanger D2, the solenoid valve V is energized to cause the valve disk 24 to part from the seat S2 to communicate the first refrigerant passage P1 and the second refrigerant passage P2. When the valve is open, no water hammer occurs because there is no throttling structure downstream of the solenoid valve V.

To stop the second indoor heat exchanger D2, the solenoid valve V is deenergized to let the valve disk 24 come into engagement with the seat S2. When the valve is closed, the water hammer can be alleviated by the gasified refrigerant downstream of the expansion valve V2.

If the solenoid valve V and the expansion valve V1, V2 are separated, because the upstream side of the solenoid valve V has high pressure, the inner pressure equalizing hole 15—which communicates to the inner pressure chamber R1 that generates a diaphragm activating pressure difference to drive the valve disk 6 in the expansion valve—is applied a high pressure, which in turn may damage the diaphragm 8. A possible countermeasure to cope with this problem may include providing an external pressure equalizing pipe between the downstream of the solenoid valve V and the expansion valve V1, V2. This measure, however, requires an additional pipe, which constitutes an inhibiting increase in structural size for the automotive air conditioner that is installed in a very limited space.

In this invention, on the other hand, the solenoid valve is added integrally to the expansion valve to reduce the pressure in the inner pressure equalizing hole 15 that communicates to the inner pressure chamber R1 defined by the diaphragm 8. This in turn protects the diaphragm against damage while at the same time simplifying the construction of the refrigeration cycle.

Figure 2:
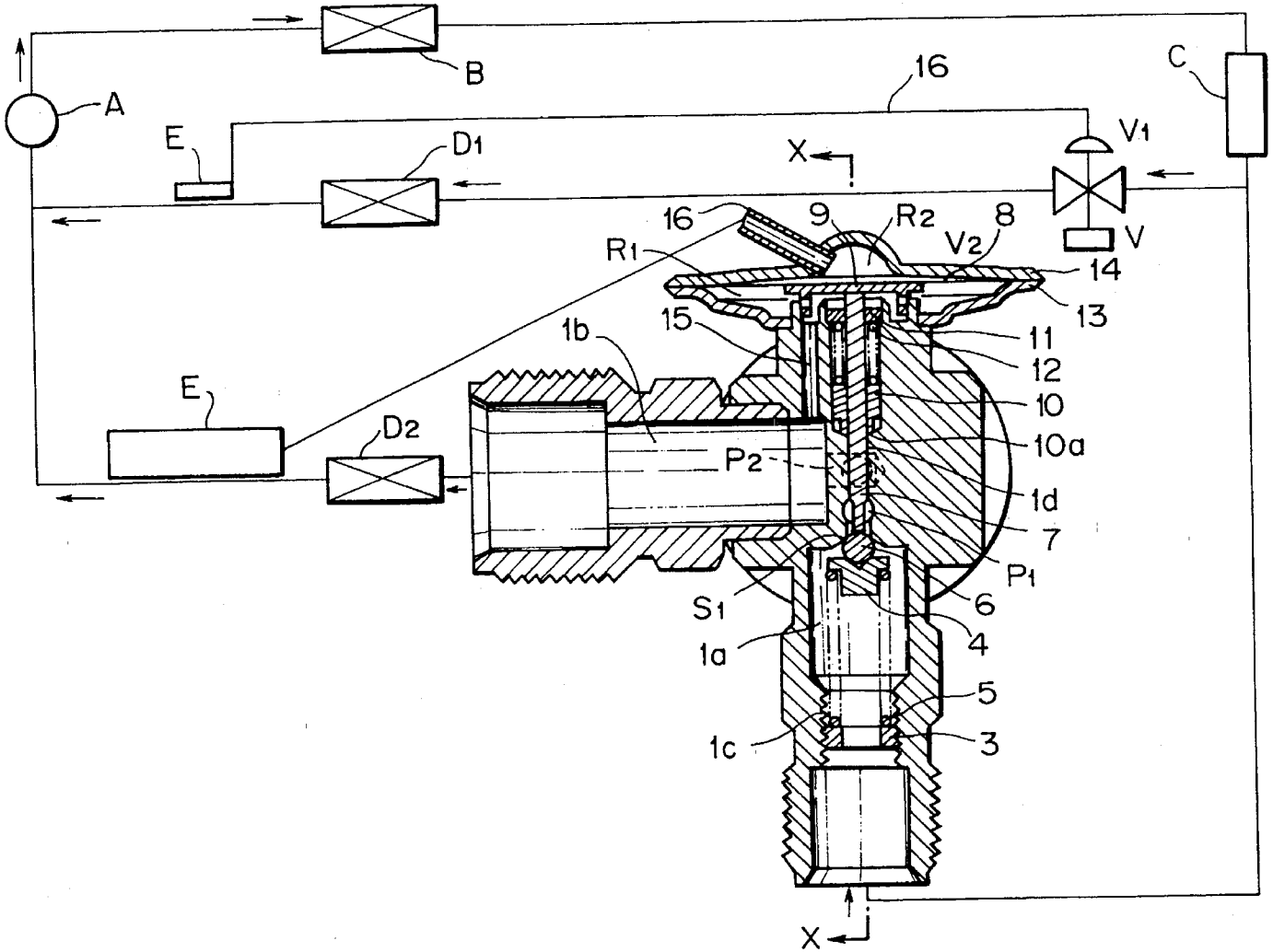
FIG. 2 is a schematic diagram of a refrigeration cycle of a second embodiment, with the expansion valve incorporating a solenoid valve shown cut away.
Figure 3:
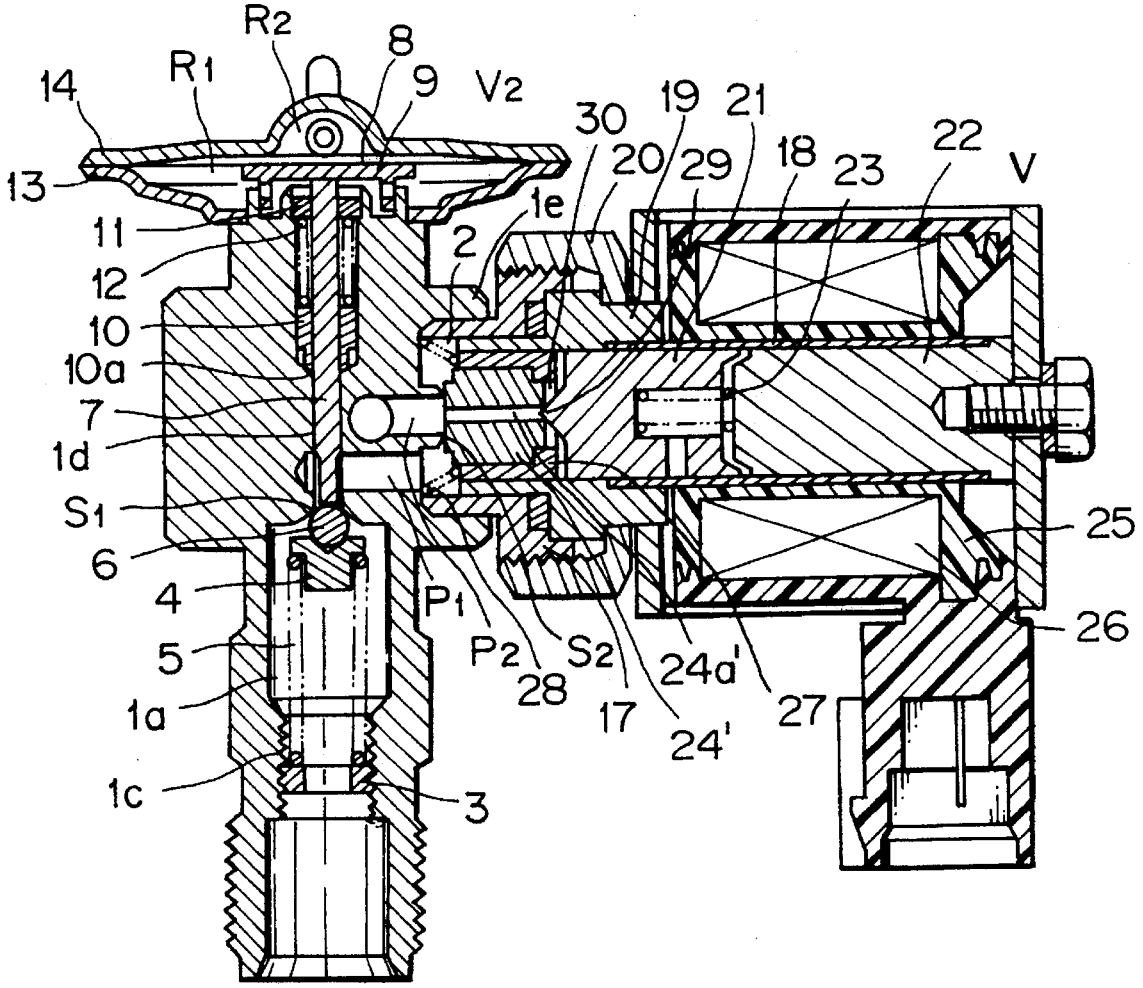
FIG. 3 is a cross section taken along the line X—X of FIG. 2.

In the structure shown in FIG. 2 and 3, the expansion valve V1, V2, as detailed in the expansion valve V2, has a first refrigerant passage P1 and a second refrigerant passage P2 between the primary port 1*a* and the secondary port 1*b* of the valve body 1. The first refrigerant passage P1 extends from the primary port 1*a* and bends nearly at right angles to reach the valve chamber 2 of the solenoid valve V. The second refrigerant passage P2 extends from the valve chamber 2 and bends nearly at right angles to reach the secondary port 1*b*. A valve seat S1 is formed at the end of the first refrigerant passage P1 on the primary port 1*a* side, and a valve seat S2 is formed at the end of the second refrigerant passage P2 on the valve chamber 2 side.

The solenoid valve V is secured to the expansion valve by fusing a jointing cylinder 17 to a connection cylinder 1*e*, which is disposed perpendicular to the secondary port 1*b*, and fixing a valve body cylinder 19 fitted with a plunger tube 18 to the jointing cylinder 17 by a nut 20. Components identical with those of FIG. 1 are assigned like reference numerals.

Inside the plunger tube 18 and the valve body cylinder 19, a main valve disk 24' integrally fitted in a sliding cylinder 27 and a plunger 21 are movably installed. The main valve disk 24' is urged by a coil spring 28 arranged between it and the valve body 1 to part from the seat S2. The plunger 21 is urged by a coil spring 23 provided between it and the attracting core 22 to push the main disk 24' through a pilot disk 29. Since the force of the coil spring 23 is set greater than that of the coil spring 28, the main disk 24' normally abuts against the valve seat S2 closing the passage.

When the main valve disk 24' is closed, the pilot disk 29 closes a pilot opening 24*a'* of the main valve disk 24' which communicates to the refrigerant passage P2, so that the high-pressure liquid refrigerant in the valve chamber 2 enters through a gap between the plunger tube 18 and the sliding cylinder 27 into a high-pressure refrigerant introducing space 30 formed behind the main valve disk 24' between it and the plunger 21, filling the space 30.

In the above construction, during the operation of the refrigeration cycle, the energized solenoid valve V attracts the plunger 21 causing the main valve disk 24' to part from the valve seat S2, so that the high-pressure liquid refrigerant flows from the primary port 1*a* through between the valve seat S1 and the expansion valve disk 6 into the valve chamber 2, from which it flows past the second refrigerant passage P2 to become a low-pressure gas refrigerant, which then enters the indoor heat exchanger D1, D2.

In the case of FIG. 3, the second refrigerant passage P2 in the expansion valve V2 is closed by the main valve disk 24' of the solenoid valve V and the pilot opening 24*a'* of the main valve disk 24' is closed by the pilot disk 29, so that the second indoor heat exchanger D2 is at rest, with the expansion valve disk 6 parting from the seat S1 at a degree of opening corresponding to the outlet temperature of the second indoor heat exchanger D2.

In this state, to start the second indoor heat exchanger D2, the solenoid valve V is energized to attract the plunger 21 to cause the pilot disk 29 to open the pilot opening 24*a'*. With the pilot opening 24*a'* open, the high-pressure liquid refrigerant in the high-pressure refrigerant introducing space 30 flows through the pilot opening 24*a*' into the second refrigerant passage P2. Because the amount of high-pressure liquid refrigerant flowing through the pilot opening 24*a*' is greater than the amount entering into the space 30, the space is depressurized, causing the main valve disk 24' to move toward the right in the drawing. The moving of the main valve disk 24' during the valve opening process is performed gradually as the pressure in the space 30 decreases, thus preventing the high-pressure liquid refrigerant in the valve chamber 2 from rapidly flowing into the second refrigerant passage P2. Because of this and because there is no throttled portion downstream of the solenoid valve, impact noise is not produced.

To stop the second indoor heat exchanger D2, the solenoid valve V is deenergized to release the plunger 21 allowing it to be pushed by the coil spring 23 and the pilot disk 29 to close the pilot opening 24*a*'. With the pilot opening 24*a*' closed, the space 30 is gradually pressurized by the high-pressure refrigerant entering into the space 30, with the result that the main valve disk 24' slowly moves toward the left in the drawing, closing the passage. Because of the slow closing and because the refrigerant is gasified, no impact noise is produced.

Figure 4:
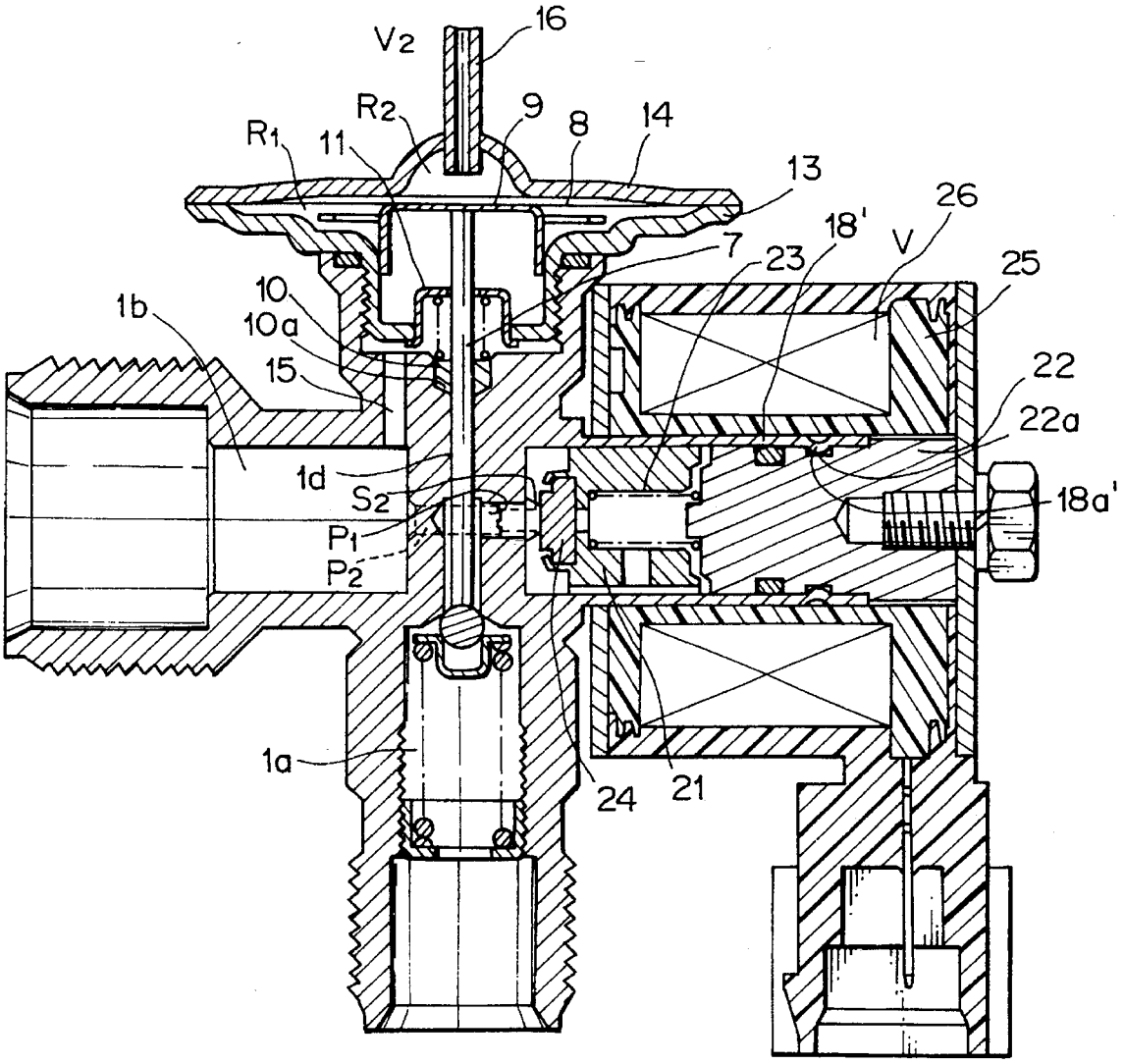
FIG. 4 is a cross section of an expansion valve similar to the expansion valve of FIG. 1 with a solenoid valve differing in construction from that of FIG. 1.

While in the example shown in FIG. 1, the solenoid valve is shown as including the jointing cylinder 17 fused to the connecting cylinder portion 1*e* of the valve body 1, the valve body cylinder 19 fitted with the plunger tube 18, and the nut 20 that fixes the valve body cylinder 19 to the jointing cylinder 17, these components may be omitted to obtain the same effect. In other words, as shown in FIG. 4, these components may be replaced by a plunger tube 18' that extends from the side of the valve body 1 opposite the secondary port 1*b*. The plunger tube 18' is near its end pinched to form an inwardly directed projection 18'*a* that engages in a corresponding recess 22*a* on the attracting core 22 to secure the plunger tube 18' to the attracting core 22.

Figure 5:
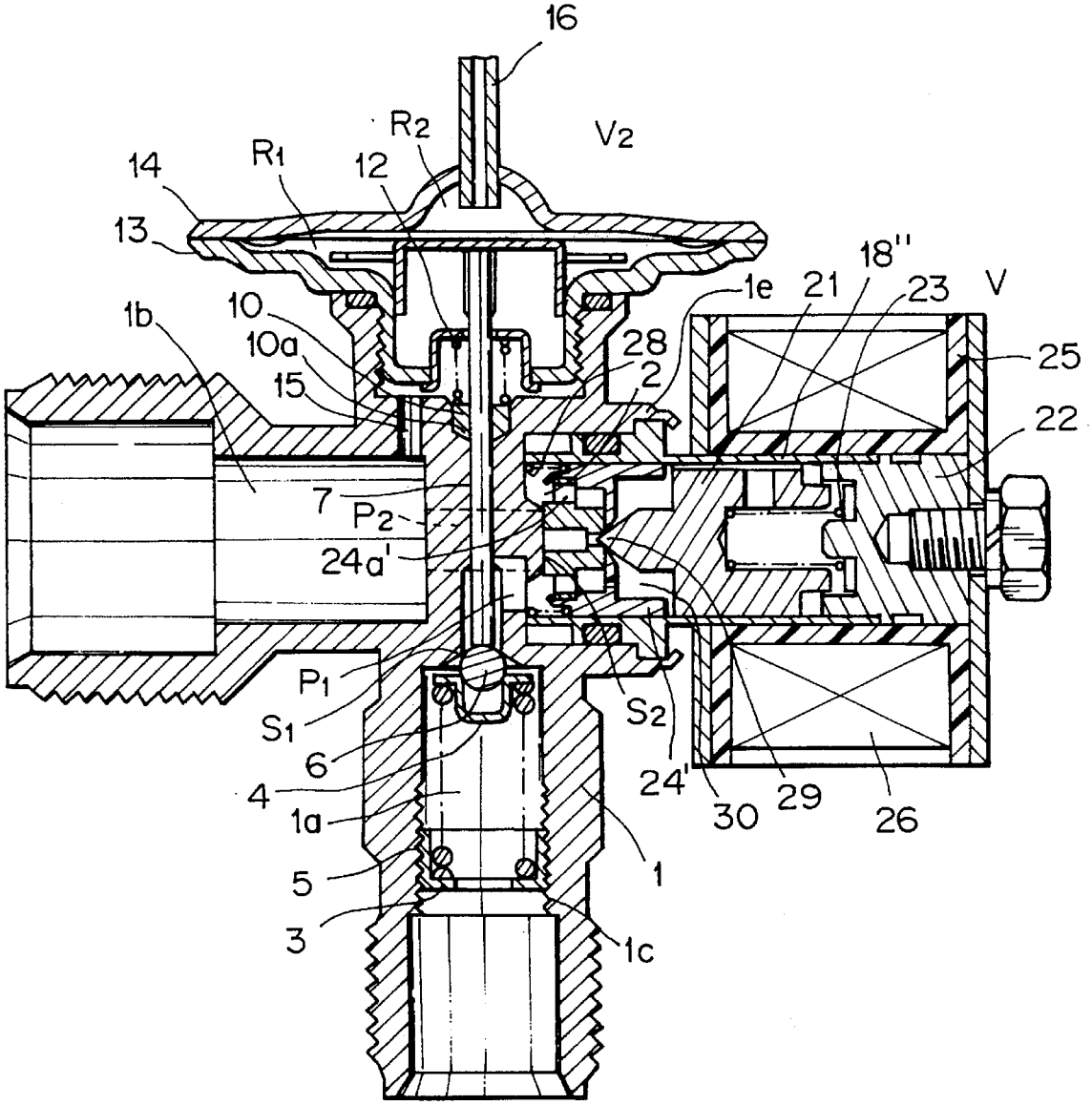
FIG. 5 is a cross section of an expansion valve similar to the expansion valve of FIGS. 2 and 3 with a solenoid valve differing in construction from that of FIGS. 2 and 3.

While in the example shown in FIGS. 2 and 3, the solenoid valve is shown as including the jointing cylinder 17, the valve body cylinder 19, and the nut 20 that fixes the valve body cylinder 19 to the jointing cylinder 17, as shown in FIG. 5, these components may be replaced by a plunger tube 18" directly secured to the connection cylinder 1*e* of the valve body 1. Likewise, in the example in FIGS. 2 and 3, the main valve disk 24' is shown as integrally fitted in the sliding cylinder 27. However, the sliding cylinder 27 may be omitted as shown in FIG. 5 to obtain the same effect.

Further, while the solenoid valve is described in the above-described examples as of the type that opens when energized, it is also possible to change the construction of the solenoid section and apply this invention to a solenoid valve that closes when energized.

As described above, the construction of the expansion valve according to this invention can prevent the occurrence of impact noise of refrigerant when the solenoid valve is operated. Further, when the solenoid valve is closed, the low-pressure refrigerant can be supplied through the inner pressure equalizing hole to the inner pressure chamber defined by the diaphragm, making the refrigeration cycle compact.

Having now fully described the invention, it will be apparent to one of ordinary skill in the art that many changes and modifications can be made thereto without departing from the spirit and scope of the invention as set forth herein.

What is claimed is:

1. An expansion valve combined with a solenoid valve for use in a refrigerant cycle, comprising:

a valve body with a primary port and a secondary port formed therein;

a refrigerant passage formed in said valve body between said primary port and said secondary port;

a solenoid valve attached to said valve body to open and close said refrigerant passage at an intermediate portion thereof;

a diaphragm defining an outer pressure chamber and an inner pressure chamber, said outer pressure chamber being communicated to a temperature sensing means;

an expansion valve member moved by action of said diaphragm to come into and out of contact with a valve seat formed at said primary port side of said refrigerant passage on an upstream side of said solenoid valve for performing a cooling operation; and an inner pressure equalizing hole formed in said valve body to communicate said secondary port side on a downstream side of said solenoid valve with said inner pressure chamber.

2. An expansion valve according to claim 1, wherein said outer pressure chamber is communicated to said temperature sensing means via a capillary tube.

3. An expansion valve according to claim 1, wherein said temperature sensing means detects heat at an outlet of a heat exchanger disposed downstream of said solenoid valve.

4. An expansion valve according to claim 1, wherein said refrigerant passage comprises a first passage, a second passage and a valve chamber formed in said solenoid valve, said first passage extending from said primary port to said valve chamber and said second passage extending from said valve chamber to said secondary port.

5. An expansion valve according to claim 4, wherein said first passage has on said valve chamber side a second valve seat whereat said refrigerant passage is opened and closed by said solenoid valve.

6. An expansion valve according to claim 4, wherein said second passage has on said valve chamber side a second valve seat whereat said refrigerant passage is opened and closed by said solenoid valve.

7. An expansion valve according to claim 4, wherein said first passage extends from said primary port in an axial direction of said valve body and bends at substantially right angles to reach said valve chamber, and wherein a working rod between said diaphragm and said expansion valve member passes through the axially extended portion of said first passage.

8. An expansion valve according to claim 7, wherein said solenoid valve is attached to said valve body at a side opposite said secondary port, and said second passage extends straight from said valve chamber to said secondary port.

9. An expansion valve according to claim 7, wherein said solenoid valve is attached to said valve body at a side perpendicular to said secondary port, and said second passage extending from said valve chamber bends substantially at right angles to reach said secondary port.

10. An expansion valve according to claim 5, wherein said solenoid valve comprises a valve member corresponding to said second valve seat, fixed to a distal end of a plunger, and a spring means that normally urges said valve member against said second valve seat via said plunger.

11. An expansion valve according to claim 5, wherein said solenoid valve comprises a valve member provided with a pilot opening therethrough for communication with said refrigerant passage when said valve member is contacted with said second valve seat, a first spring means that urges said valve member to part from said second valve seat, a plunger provided at a distal end thereof with a pilot valve member corresponding to said pilot opening of said valve member, said valve member and said plunger separately movable and form a refrigerant introducing space therebetween when they are in contact with each other, and a second spring means that normally urges said valve member against said second valve seat via said pilot valve member of said plunger with a force greater than that of said first spring means.

* * * * *